US006267300B1

(12) United States Patent
Venema

(10) Patent No.: US 6,267,300 B1
(45) Date of Patent: Jul. 31, 2001

(54) SPRAY BACK FLUID APPLICATOR

(75) Inventor: Benjamin J. Venema, Seattle, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/453,853

(22) Filed: Dec. 9, 1999

(51) Int. Cl.[7] ..... B05B 1/28

(52) U.S. Cl. ..... 239/290; 239/292; 239/295; 239/300; 239/532

(58) Field of Search ..... 239/290, 292, 239/295, 300, 532

(56) References Cited

U.S. PATENT DOCUMENTS

| | | | | |
|---|---|---|---|---|
| 1,653,907 | * | 12/1927 | Hilgerink | 239/532 |
| 2,610,092 | | 9/1952 | Thompson . | |
| 3,056,558 | | 10/1962 | Gilliland et al. . | |
| 3,085,750 | * | 4/1963 | Kenshol | 239/295 |
| 3,385,526 | | 5/1968 | Furrer . | |
| 3,690,563 | | 9/1972 | Farrington et al. . | |
| 3,904,116 | * | 9/1975 | Jones et al. | 239/532 |
| 3,915,382 | * | 10/1975 | Davis | 239/532 |
| 4,114,812 | * | 9/1978 | Austin et al. | 239/532 |
| 4,986,210 | * | 1/1991 | Hollstein et al. | 239/295 |
| 4,998,993 | | 3/1991 | Kenderi et al. . | |
| 5,152,462 | * | 10/1992 | Evans | 239/532 |
| 5,186,392 | * | 2/1993 | Pleshek | 239/532 |
| 5,271,564 | * | 12/1993 | Smith | 239/290 |
| 5,565,241 | | 10/1996 | Mathias et al. . | |

* cited by examiner

*Primary Examiner*—David A. Scherbel
*Assistant Examiner*—Dinh Q. Nguyen
(74) *Attorney, Agent, or Firm*—Lawrence W. Nelson

(57) ABSTRACT

A fluid applicator used to apply an even coat of fluid to a surface which is not accessible along a longitudinal axis of the applicator. The applicator includes a fluid delivery system that delivers the fluid under low pressure, and has a distal end bent 30° to 60° from the applicator's longitudinal axis. The applicator also has an air delivery system with a distal end bent at an angle identical to the distal end of the fluid delivery system. The air delivery system delivers a high pressure jet of air 90° relative to the fluid, thereby aspirating the fluid and ejecting it onto the inaccessible surface.

8 Claims, 1 Drawing Sheet

SPRAY BACK FLUID APPLICATOR

FIELD OF THE INVENTION

The present invention relates to an apparatus for the dispensing of liquids, and, more particularly, to an applicator for spraying a fluid onto a surface.

BACKGROUND ART

At present, most fluid dispensing applicators are only capable of spraying along a direction longitudinal to the applicator, i.e., in a straight forward direction. However, in practice, an operator is often confronted with the task of coating the backside or "unviewable side" of a structure. The unviewable side is typically inaccessible because it is covered by a panel or other obstacle. In aerospace, this situation arises frequently; for example, the unviewable side of "stringers" in an airplane wing must be coated with a liquid/fluid. This work is presently performed manually using bent brushes. The disadvantage to this form of application is that it is expensive, unreliable, and uncomfortable to perform.

A further disadvantage to the use of bent brushes to apply coatings to an unviewable surface is that some coatings cannot be applied onto a surface in the desired quantity or quality using this form of application. Further, obtaining an even coating using a bent brush is virtually impossible.

SUMMARY OF THE INVENTION

In one aspect, the present invention relates to an apparatus for coating a fluid onto an unviewable surface. The apparatus includes a fluid feed system having a pressure pot for pressurizing the fluid, a variable fluid control unit for controlling the feed rate of the fluid, and a fluid line for delivering the fluid. The fluid line is bent 30° to 60° to allow the fluid to be distributed to the unviewable surface. A fluid spray tip dispenses the fluid under low pressure. The apparatus also includes an air feed system, having a compressed air source for pressurizing air, and an air line for delivering the air. The air line is parallel to the fluid line and bent 30° to 60° to allow a jet of air to be directed at the unviewable surface. An air spray tip is positioned 90° relative to the fluid spray tip for providing a high pressure jet of air to contact the low pressure fluid on the fluid spray tip and atomize the fluid ejecting onto the unviewable surface in an even manner.

In another aspect, the present invention relates to a fluid applicator used to apply an even coat of fluid to a surface which is not accessible along a longitudinal axis to the applicator. The applicator includes a fluid delivery system that delivers the fluid at a low pressure, and has a distal end bent 30° to 60° from the applicator's longitudinal axis. The applicator also includes an air delivery system having a distal end bent at an angle identical to the distal end of the fluid delivery system. The air delivery system delivers a high pressure jet of air 90° relative to the fluid, thereby aspirating the fluid and ejecting it onto the surface.

DETAILED DESCRIPTION OF PREFERRED EMBODIMENTS

Figure 1:
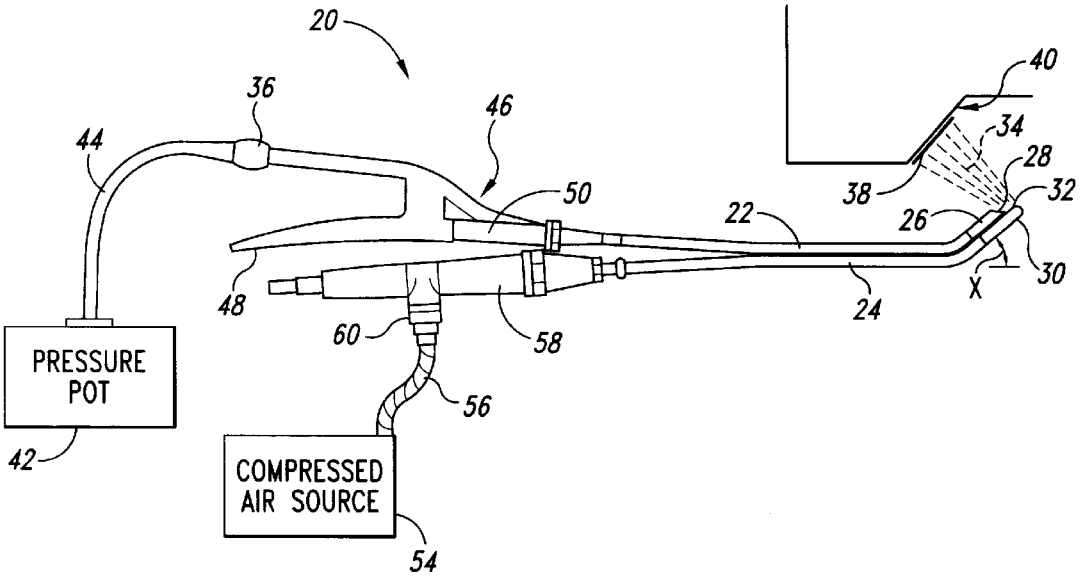
FIG. 1 shows a side view of a spray back applicator of an embodiment of the present invention.
Figure 2:
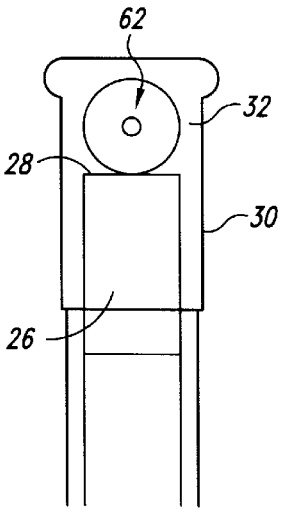
FIG. 2 shows a front view of an air spray tip of the spray back applicator.
Figure 3:
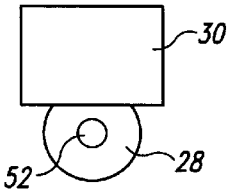
FIG. 3 shows a front view of a fluid spray tip of the spray back applicator.

FIG. 1 shows a spray back applicator 20 of the present invention which includes a fluid line 22 and an air line 24, each bent near the distal end by same angle x. The fluid line 22 includes a fluid spray cap 26 having a fluid spray tip 28, as shown in FIG. 3, which dispenses fluid under low pressure. The air line 24 includes an air line spray cap 30 having an air spray tip 32, as shown in FIG. 2, which provides a jet of high pressure air that atomizes the fluid on the fluid spray tip 28 and ejects an entrained air stream 34 at a right angle to the fluid spray tip 28. The bending of the fluid line 22 and the air line 24 by the angle x used in conjunction with the above-described method of aspiration at a right angle to the fluid line 22 allows the entrained air stream 34 to reach an unviewable surface 40, and apply an even fluid coating 38 thereon.

The fluid is supplied by a pressure pot 42, which preferably pressurizes the fluid to approximately 10 psi. The pressure pot 42 is coupled to a fluid hose 44, which in turn is coupled to a variable fluid control unit 46 via a fluid coupling 36.

The variable fluid control unit 46 includes a handle 48 and a piston valve 50. The piston valve 50 variably obstructs, i.e., controls the amount and rate of fluid provided to, the fluid line 22. The handle 48 is positioned to allow an operator to control the flow of the fluid and properly position the spray back applicator 20 using the same hand.

The fluid spray tip 28, as shown in FIG. 3, dispenses the fluid via a fluid orifice 52, which is preferably 40 millimeters in diameter. The spray tip 28 is preferably made of Delrin®. By using Delrin®, the spray tip 28 won't wear out or clog for the life of the applicator 20.

The pressurized air is supplied by a compressed air source 54, which preferably pressurizes ambient air to 100 psi. The air source 54 is coupled to an air hose 56, which in turn is coupled to an air manifold 58 via an air coupling 60. The air manifold is coupled directly to the air line 24.

The air spray tip 32, as shown in FIG. 2, provides the jet of air via an air orifice 62, which is preferably 80 millimeters in diameter. The air tip 32 is preferably Delrin®. By using Delrin®, the air spray tip 32 should not wear out for the life of the applicator 20.

The fluid line 22 and the air line 24 are preferably made of a durable lightweight metal, and each of the lines preferably has a small diameter to keep the applicator 20 lightweight and easy to manage and maneuver into small openings.

The spray back applicator 20 operates as follows. Initially, the pressure pot 42 and the compressed air source 54 are activated by an operator. Once the air source 54 is activated, a constant flow of high pressure air, preferably 100 psi, is provided to the air spray tip 32 via the air hose 56, the air manifold 58, the air line 24, and the air line spray cap 30.

On the other hand, the pressure pot 42, once activated, supplies pressurized fluid, such as paint, lubricant, corrosion-inhibiting compounds, or some other fluid which requires even application, to the variable fluid control unit 46, via fluid hose 44. The fluid stops moving until an operator depresses the handle 48. The handle 48 operates the piston valve 50, allowing the operator to control the amount of the fluid leaving the control unit 46. The more the handle 48 is depressed, the farther the piston valve 50 is withdrawn from the fluid line 22 and the more fluid flows to the fluid spray tip 28 via the fluid line 22 and the fluid cap 26.

The operator extends the applicator 20 behind the unviewable surface 40 either via an aperture or some other form of access point, squeezes the handle 48, and releases the entrained air stream 34 to apply the even coat 38.

Accordingly, the present invention provides a means for applying an even coat of fluid to an otherwise inaccessible unviewable area.

What is claimed is:

1. An apparatus for coating a fluid onto an unviewable surface comprising:

a fluid feed system including:

a pressure pot for pressurizing the fluid;

a variable fluid control unit for controlling the feed rate of the fluid;

a fluid line for delivering the fluid, said fluid line being bent between 30° and 60° to allow the fluid to be distributed to the unviewable surface; and a fluid spray tip for dispensing the fluid under low pressure; and an air feed system including:

a compressed air source for pressurizing air;

an air line for delivering the air, said air line being parallel to said fluid line and bent between 30° and 60° to allow a jet of air to be directed at the unviewable surface; and an air spray tip positioned 90° relative to said fluid spray tip for providing a high pressure jet of air to contact the low pressure fluid on said fluid spray tip and atomize and eject the fluid onto the unviewable surface in an even manner.

2. The apparatus according to claim 1, wherein said variable fluid control unit includes:

a piston positioned between said fluid line and said pressure pot to control an amount of fluid reaching said fluid spray tip; and a handle coupled to said piston for regulating the position of said piston.

3. The apparatus according to claim 1, wherein said air spray tip includes an air orifice having a diameter of 80 millimeters.

4. The apparatus according to claim 1, wherein said fluid spray tip includes a fluid orifice having a diameter of 40 millimeters.

5. The apparatus according to claim 1, wherein said pressure pot pressurizes the fluid to 10 psi.

6. The apparatus according to claim 1, wherein said compressed air source pressurizes the air to 100 psi.

7. A fluid applicator used to apply an even coat of fluid to a surface which is not accessible along a longitudinal axis of the applicator, the surface being positioned 120° to 150° relative to the longitudinal axis of the applicator, said applicator comprising:

a fluid delivery system that delivers the fluid under low pressure having a distal end bent 30° to 60° from the longitudinal axis of the applicator; and an air delivery system having a distal end bent at an angle identical to said distal end of said fluid delivery system, wherein the air delivery system delivers a high pressure jet of air 90° relative to the fluid, thereby aspirating the fluid and ejecting it onto the surface.

8. The applicator according to claim 7, wherein said fluid delivery system includes:

a fluid spray tip for dispensing the fluid; and an air spray tip for directing the high pressure jet of air, said air spray tip being positioned 90° relative to said fluid spray tip.

* * * * *